US011501703B2

(12) United States Patent
Liu et al.

(10) Patent No.: US 11,501,703 B2
(45) Date of Patent: Nov. 15, 2022

(54) DATA CURRENT GENERATION CIRCUIT, DRIVING METHOD THEREFOR, DRIVER CHIP, AND DISPLAY PANEL

(71) Applicant: SEEYA OPTRONICS CO., LTD., Shanghai (CN)

(72) Inventors: Ping-Lin Liu, Shanghai (CN); Haodong Zhang, Shanghai (CN)

(73) Assignee: SEEYA OPTRONICS CO., LTD., Shanghai (CN)

( * ) Notice: Subject to any disclaimer, the term of this patent is extended or adjusted under 35 U.S.C. 154(b) by 0 days.

(21) Appl. No.: 17/395,235

(22) Filed: Aug. 5, 2021

(65) Prior Publication Data

US 2022/0208087 A1 Jun. 30, 2022

(30) Foreign Application Priority Data

Dec. 31, 2020 (CN) ..... 202011634641.4

(51) Int. Cl.

*G09G 3/3208* (2016.01)
*G09G 3/3283* (2016.01)
*G09G 3/3291* (2016.01)

(52) U.S. Cl.

CPC ..... *G09G 3/3208* (2013.01); *G09G 3/3283* (2013.01); *G09G 3/3291* (2013.01); *G09G 2300/0426* (2013.01); *G09G 2300/0809* (2013.01); *G09G 2310/0243* (2013.01); *G09G 2310/0291* (2013.01); *G09G 2310/08* (2013.01)

(58) Field of Classification Search

CPC .. G09G 3/3208; G09G 3/3283; G09G 3/3291; G09G 2300/0426; G09G 2300/0809; G09G 2310/0243; G09G 2310/0291; G09G 2310/08

USPC ..... 345/214

See application file for complete search history.

(56) References Cited

U.S. PATENT DOCUMENTS 8,890,777 B2 * 11/2014 Ryu ..... G09G 3/3233 345/82
10,338,730 B2 * 7/2019 Kim ..... G06F 3/0416
11,315,493 B2 * 4/2022 Min ..... G09G 3/3258
2009/0140959 A1 * 6/2009 Nam ..... G09G 3/325 345/76
2016/0071445 A1 * 3/2016 Kim ..... G09G 3/3291 345/212

(Continued)

*Primary Examiner* — Tom V Sheng

(74) *Attorney, Agent, or Firm* — Wolf, Greenfield & Sacks, P.C.

(57) ABSTRACT

Provided are a data current generation circuit, a driving method therefor, a driver chip, and a display panel, where a threshold capture module of the data current generation circuit is connected between a gate and a second electrode of a first transistor and is configured to capture a threshold voltage of the first transistor, a data voltage generation module is configured to generate a data voltage, a data voltage transmission module is connected between the data voltage generation module and a threshold voltage acquisition and superposition module and is configured to transmit the data voltage generated by the data voltage generation module to the threshold voltage acquisition and superposition module when the data voltage transmission module is turned on, and the threshold voltage acquisition and superposition module is configured to acquire the threshold voltage of the first transistor.

13 Claims, 9 Drawing Sheets

(56) References Cited

U.S. PATENT DOCUMENTS

| | | | | |
|---|---|---|---|---|
| 2016/0148578 | A1* | 5/2016 | Kishi | G09G 3/3291<br>345/212 |
| 2017/0061892 | A1* | 3/2017 | Jung | G09G 3/3291 |
| 2017/0162125 | A1* | 6/2017 | Liang | G09G 3/3233 |
| 2018/0053462 | A1* | 2/2018 | Bae | G09G 3/2074 |
| 2021/0043148 | A1* | 2/2021 | Lee | G09G 3/3291 |

* cited by examiner

DATA CURRENT GENERATION CIRCUIT, DRIVING METHOD THEREFOR, DRIVER CHIP, AND DISPLAY PANEL

CROSS-REFERENCE TO RELATED APPLICATION(S)

This application claims foreign priority benefits under 35 U.S.C. § 119(a)-(d) or 35 U.S.C. § 365(b) of Chinese patent application No. CN 202011634641.4 filed on Dec. 31, 2020, disclosure of which is incorporated herein by reference in its entirety.

TECHNICAL FIELD

The present disclosure relates to the field of display technology and, in particular, to a data current generation circuit, a driving method therefor, a driver chip, and a display panel.

BACKGROUND

The current-type pixel driver circuit includes a pixel drive current generation circuit that supplies a data current to a pixel circuit. The pixel drive current generation circuit may convert a data voltage into a data current to supply the data current to the pixel circuit.

In the process where the pixel drive current generation circuit converts the data voltage into the data current, since the transistor generating the data current has a threshold voltage, the converted data current may be deviated from the data voltage by a certain variation, resulting in poor uniformity of the display panel.

SUMMARY

Embodiments of the present disclosure provide a data current generation circuit, a driving method therefor, a driver chip, and a display panel, to improve the uniformity of the display panel.

In a first aspect, an embodiment of the present disclosure provides a data current generation circuit. The data current generation circuit includes a threshold capture module, a data voltage generation module, a data voltage transmission module, a threshold voltage acquisition and superposition module, and a first transistor.

The threshold capture module is connected between a gate and a second electrode of the first transistor and is configured to capture a threshold voltage of the first transistor.

The data voltage generation module is configured to generate a data voltage.

The data voltage transmission module is connected between the data voltage generation module and the threshold voltage acquisition and superposition module and is configured to transmit the data voltage generated by the data voltage generation module to the threshold voltage acquisition and superposition module when the data voltage transmission module is turned on.

The threshold voltage acquisition and superposition module is connected to the gate and a first electrode of the first transistor and is configured to acquire the threshold voltage of the first transistor, superpose the data voltage transmitted by the data voltage transmission module and the threshold voltage, and transmit the superposed data voltage and threshold voltage to the gate of the first transistor.

The second electrode of the first transistor serves as an output terminal of the data current generation circuit and is configured to output a data current according to the voltage of the gate of the first transistor.

In a second aspect, an embodiment of the present disclosure provides a data current driver chip. The data current driver chip includes the data current generation circuit provided by any one of the embodiments of the present disclosure.

In a third aspect, an embodiment of the present disclosure further provides a display panel. The display panel includes a display region and a non-display region. The display region is provided with a plurality of pixel circuits, and the non-display region is provided with the data current generation circuit provided by any one of the embodiments of the present disclosure.

Each pixel circuit is electrically connected to the data current generation circuit through a data line and a switch module. A data current generated by the data current generation circuit is supplied to each pixel circuit through the data line and the switch module.

In a fourth aspect, an embodiment of the present disclosure further provides a driving method of a data current generation circuit. The driving method of a data current generation circuit is configured to drive the data current generation circuit provided by any one of the embodiments of the present disclosure and includes the steps described below.

At a reset stage, the data voltage generation module of the data current generation circuit is controlled to output a data voltage to the data voltage transmission control module, and a compensation control module is controlled to associate a threshold voltage of the first transistor of the data current generation circuit to a gate of the first transistor.

At a programming stage, the data voltage transmission control module is controlled to output the data voltage to the gate of the first transistor, and the first transistor outputs a data current according to the voltage of the gate.

In the present disclosure, the data current generation circuit includes a threshold capture module, a data voltage generation module, a data voltage transmission module, a threshold voltage acquisition and superposition module, and a first transistor. In the operating process of the data current generation circuit, the threshold capture module is connected between the gate and the second electrode of the first transistor to capture a threshold voltage of the first transistor, the data voltage generation module may generate a data voltage, the data voltage transmission module transmits the data voltage to the threshold voltage acquisition and superposition module, the threshold voltage acquisition and superposition module can superpose the threshold voltage of the first transistor and the data voltage and then transmit the superposed data voltage and threshold voltage to the gate of the first transistor, and the second electrode of the first transistor serves as an output terminal of the data current generation circuit and outputs a data current according to the voltage of the gate. In the embodiments, the gate voltage of the first transistor for outputting a data current is correlated with the threshold voltage of the first transistor. When the first transistor outputs the data current, the gate voltage may compensate for the influence of the threshold voltage of the first transistor on the data current to improve the degree of matching between the data voltage and the data current, thereby improving the uniformity of the display panel.

DETAILED DESCRIPTION

Figure 1:
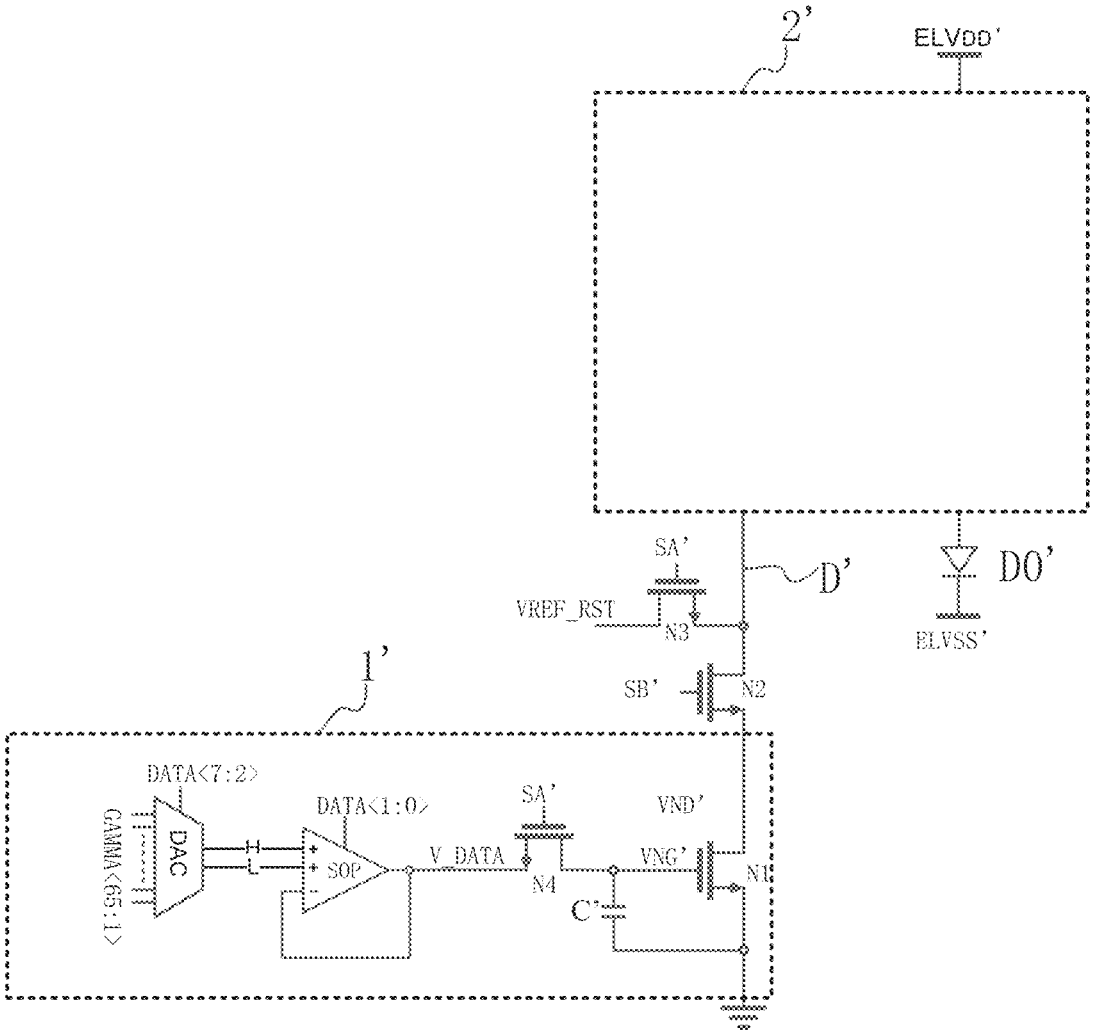
FIG. 1 is a structural diagram showing a data current generation circuit supplying a data current to a pixel circuit in the related art.

The present disclosure is described in more detail hereinafter with reference to the drawings and embodiments. It is to be understood that the embodiments described below are intended to explain and not to limit the present disclosure. In addition, it is to be noted that to facilitate description, only part, not all, of structures correlated with the present disclosure are illustrated in the drawings.

FIG. 1 is a structural diagram showing a data current generation circuit supplying a data current to a pixel circuit in the related art. As shown in FIG. 1, the data current generation circuit 1' includes a source operational amplifier SOP, a first N-type transistor N1, and a second N-type transistor N4. The data current generation circuit 1' is connected to the pixel circuit 2' through the data line D'. A third N-type transistor N2 functioned as a switch and a fourth N-type transistor N3 for resetting are configured along the data line D'. With reference to FIG. 1, in the process of driving the pixel circuit to operate, the input terminal of the source operational amplifier SOP inputs a first level signal and a second level signal outputted by the digital-to-analog converter DAC. The input terminal of the digital-to-analog converter DAC inputs a gamma voltage. When the gamma voltage includes 65 voltage values, the first level signal and the second level signal are two adjacent gamma voltages among the gamma voltages GAMMA<65:1> selected by the digital-to-analog converter DAC according to DATA<7:2> in data DATA<7:0>, where DATA<7:0> is a digital signal of 8 bits, and DATA<7:2> is 6 high bits in DATA<7:0>. The source operational amplifier SOP interpolates a data voltage V_DATA corresponding to the grayscale between the voltage of the first level signal and the second level signal according to DATA<1:0> and outputs the data voltage V_DATA to the second N-type transistor N4, where DATA<1:0> is 2 low bits in DATA<7:0>. The source operational amplifier SOP may be a multi-bit interpolating circuit or a buffer circuit of unity gain, which is not limited in this embodiment.

The specific operating process of the data current generation circuit 1' is as follows: at the reset stage Reset of the process in which the pixel circuit 2' is driven to operate, the reset control signal inputted by the reset control signal input terminal SA' is a logic high signal, the switch control signal inputted by the switch control input terminal SB' is a logic low signal, and the data voltage V_DATA outputted by the source operational amplifier SOP is inputted to the gate of the first N-type transistor N1 and the capacitor C' through the second N-type transistor N4 and is held through the capacitor C' while the reset signal VREF_RST being written into the pixel circuit 2' through the fourth N-type transistor N3; at the data write stage Program of the process in which the pixel circuit 2' is driven to operate, the reset control signal inputted by the reset control signal input terminal SA' is a logic low signal, the switch control signal inputted by the switch control input terminal SB' is a logic high signal, and the first N-type transistor N1 outputs a data current according to the data voltage V_DATA of the gate and inputs the data current V_DATA to the pixel circuit 2' through the third N-type transistor N2; and at the light emission stage t3 of the process in which the pixel circuit 2' is driven to work, the reset control signal inputted by the reset control signal input terminal SA' is a logic high signal, the switch control signal inputted by the switch control input terminal SB' is a logic low signal, and the pixel circuit 2' outputs a data current to drive the light-emitting device OLED to emit light. Meanwhile, the second N-type transistor N4 and the fourth N-type transistor N3 are turned on to make preparations for outputting the data voltage V_DATA in the next frame. As can be seen from the above-mentioned process in which the pixel circuit 2' is driven to work, the first N-type transistor N1 converts the data voltage V_DATA into a data current to supply the data current I_DATA to the pixel circuit 2'. The data current I_DATA generated by the first N-type transistor N1 is correlated with the threshold voltage of the first N-type transistor N1. The threshold voltages of different first N-type transistors N1 may deviate from each other due to the process or the like so that the data currents converted by the different first N-type transistors N1 may deviate from each other under the same data voltage V_DATA, thereby causing the data currents I_DATA outputted by the different data current generation circuits F to be different, causing the light-emitting devices D0' to be different from each other in the light-emitting brightness, and causing the poor uniformity of display panel.

Figure 2:
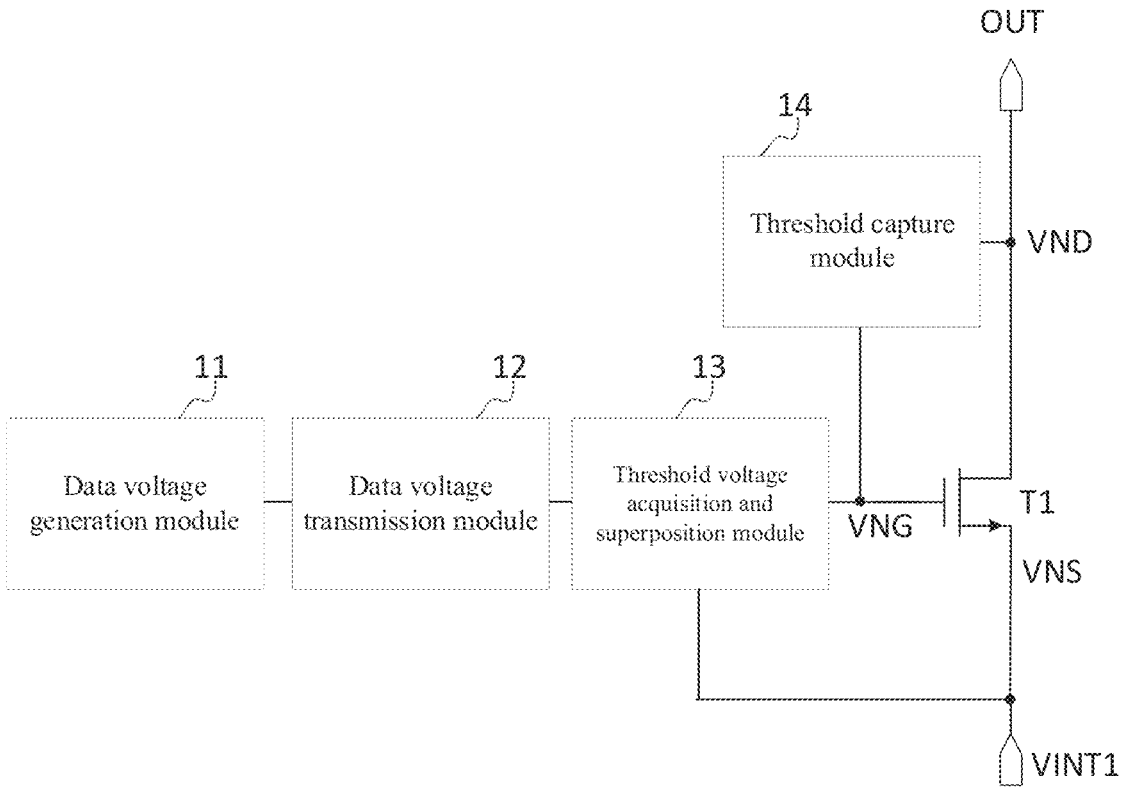
FIG. 2 is a structural diagram of a data current generation circuit according to an embodiment of the present disclosure.

To solve the above-mentioned problems, an embodiment of the present disclosure provides a data current generation circuit. FIG. 2 is a structural diagram of a data current generation circuit according to an embodiment of the present disclosure. As shown in FIG. 2, the data current generation circuit includes a threshold capture module 14, a data voltage generation module 11, a data voltage transmission module 12, a threshold voltage acquisition and superposition module 13, and a first transistor T1.

The threshold capture module 14 is connected between a gate and a second electrode VND of the first transistor T1 and is configured to capture a threshold voltage of the first transistor T1.

The data voltage generation module 11 is configured to generate a data voltage.

The data voltage transmission module 12 is connected between the data voltage generation module 11 and the threshold voltage acquisition and superposition module 13 and is configured to transmit the data voltage generated by the data voltage generation module 11 to the threshold voltage acquisition and superposition module 13 when the data voltage transmission module 11 is turned on.

The threshold voltage acquisition and superposition module 13 is connected to the gate VNG and a first electrode VNS of the first transistor T1 and is configured to acquire the threshold voltage of the first transistor T1, superpose the data voltage transmitted by the data voltage transmission module 12 and the threshold voltage, and transmit the superposed data voltage and threshold voltage to the gate of the first transistor T1.

The second electrode of the first transistor T1 serves as an output terminal OUT of the data current generation circuit and is configured to output a data current according to a voltage of the gate of the first transistor T1.

In this embodiment, the data current generation circuit includes a threshold capture module, a data voltage generation module, a data voltage transmission module, a threshold voltage acquisition and superposition module, and a first transistor. In the operating process of the data current generation circuit, the threshold capture module is connected between the gate and the second electrode of the first transistor to capture a threshold voltage of the first transistor, the data voltage generation module may generate a data voltage, the data voltage transmission module transmits the data voltage to the threshold voltage acquisition and superposition module, the threshold voltage acquisition and superposition module can superpose the threshold voltage of the first transistor and the data voltage and then transmit the superposed data voltage and threshold voltage to the gate of the first transistor, and the second electrode of the first transistor serves as an output terminal of the data current generation circuit and outputs a data current according to the voltage of the gate. In this embodiment, since the threshold voltage acquisition and superposition module superposes the threshold voltage of the first transistor and the data voltage and transmits the superposed data voltage and threshold voltage to the gate of the first transistor, the threshold voltage of can be compensated for, and the operation in which the first transistor outputs the data current is independent of the threshold voltage of the first transistor, thereby improving the uniformity of the display panel. The threshold voltage acquisition and superposition module can also store the threshold voltage of the first transistor and supply the corresponding data voltage and the threshold voltage to the gate of the first transistor after superimposing the data voltage and the threshold voltage during the row scanning. Within the time of one frame, it is not necessary to perform threshold capture in each row, and the time of threshold compensation in one frame is not necessarily captured in each row. Compared with the related art in which threshold capture is performed in each row within one frame, the solution provided by this embodiment of the present disclosure can save the time of threshold capture and compensation, thereby reducing the time required for scanning in one row.

Figure 3:
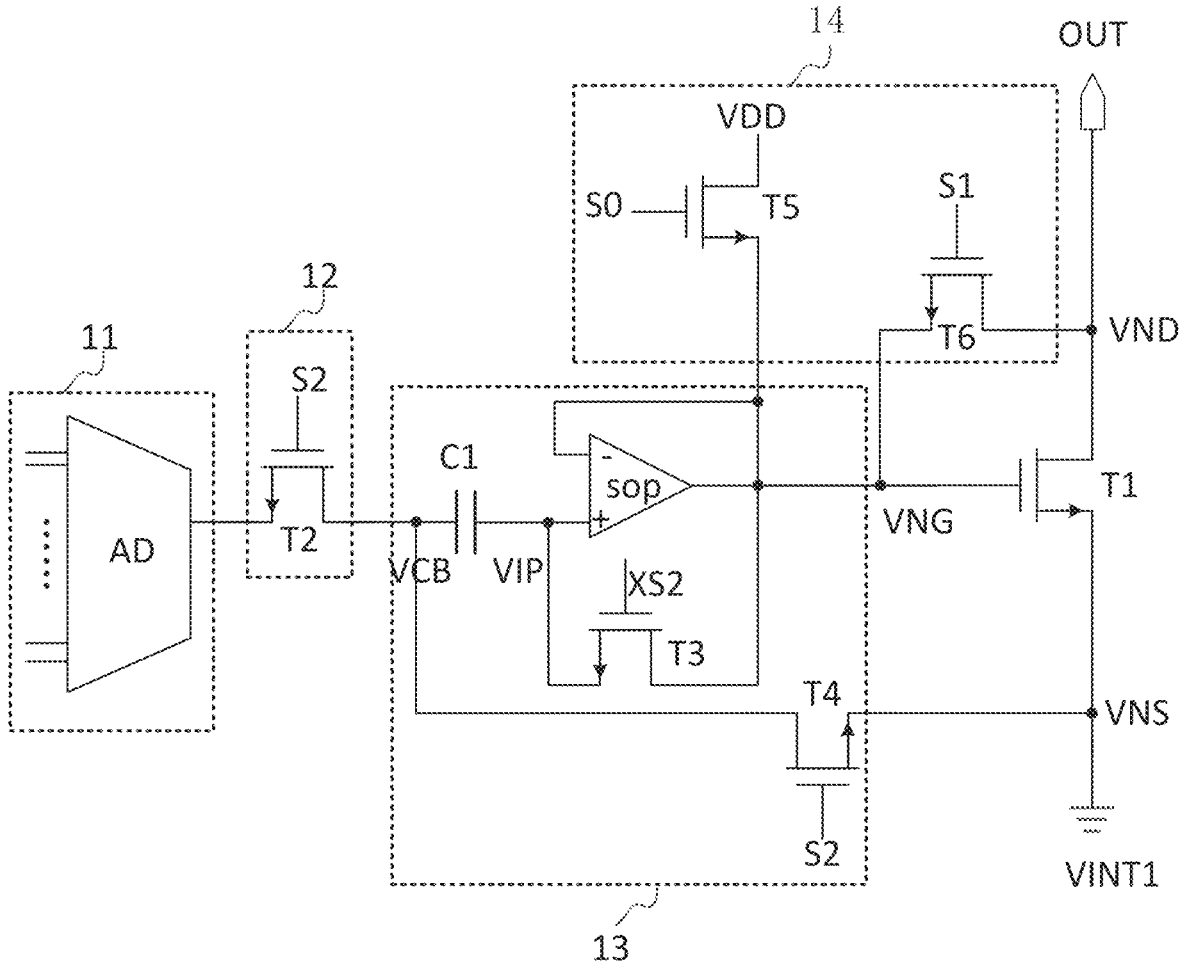
FIG. 3 is a structural diagram of another data current generation circuit according to an embodiment of the present disclosure.

FIG. 3 is a circuit diagram of another data current generation circuit according to an embodiment of the present disclosure. With reference to FIG. 3, optionally, the data voltage transmission module 12 may include a second transistor T2. The gate of the second transistor T2 is electrically connected to a first control signal input terminal S2, the first electrode of the second transistor T2 is electrically connected to the data voltage generation module 11, and the second electrode of the second transistor T2 is electrically connected to the threshold voltage acquisition and superposition module 13.

The threshold voltage acquisition and superposition module 13 may include a third transistor T3, a fourth transistor T4, a first capacitor C1, and an operational amplifier SOP. The first electrode of the first capacitor C1 is connected to the data voltage transmission module 12, the second electrode of the first capacitor C1 is connected to the first input terminal of the operational amplifier SOP, and the second input terminal of the operational amplifier SOP is connected to the output terminal of the operational amplifier SOP. The first electrode of the third transistor T3 is connected to the first input terminal of the operational amplifier SOP, the second electrode of the third transistor T3 is connected to the output terminal of the operational amplifier SOP, and the gate of the third transistor T3 is electrically connected to a second control signal input terminal XS2. The first electrode of the fourth transistor T4 is connected to the first electrode of the first capacitor C1, the second electrode of the fourth transistor T4 is connected to the first electrode of the first transistor T1 and is connected to a reference voltage VINT1, and the gate of the fourth transistor T4 is electrically connected to the second control signal input terminal XS2.

Optionally, the threshold capture module 14 may include a fifth transistor T5 and a sixth transistor T6. The second electrode of the fifth transistor T5 is connected to a first level signal input terminal VDD, the first electrode of the fifth transistor T5 is connected to the gate of the first transistor T1, and the gate of the fifth transistor T5 is connected to a third control signal input terminal S0. The first electrode of the sixth transistor T6 is connected to the gate of the first transistor T1, the second electrode of the sixth transistor T6 is connected to the second electrode of the first transistor T1, and the gate of the sixth transistor T6 is connected to a fourth control signal input terminal S1. In this embodiment, only one fixed voltage needs to be supplied to the first electrode VNS of the first transistor T1, and the reference voltage VINT1 inputted to the first electrode VNS of the first transistor T1 may be a preset fixed voltage as long as this voltage may ensure that the first transistor T1 operates in a saturation state and a data current is supplied. Optionally, the first electrode VNS of the first transistor T1 is grounded.

Figure 4:
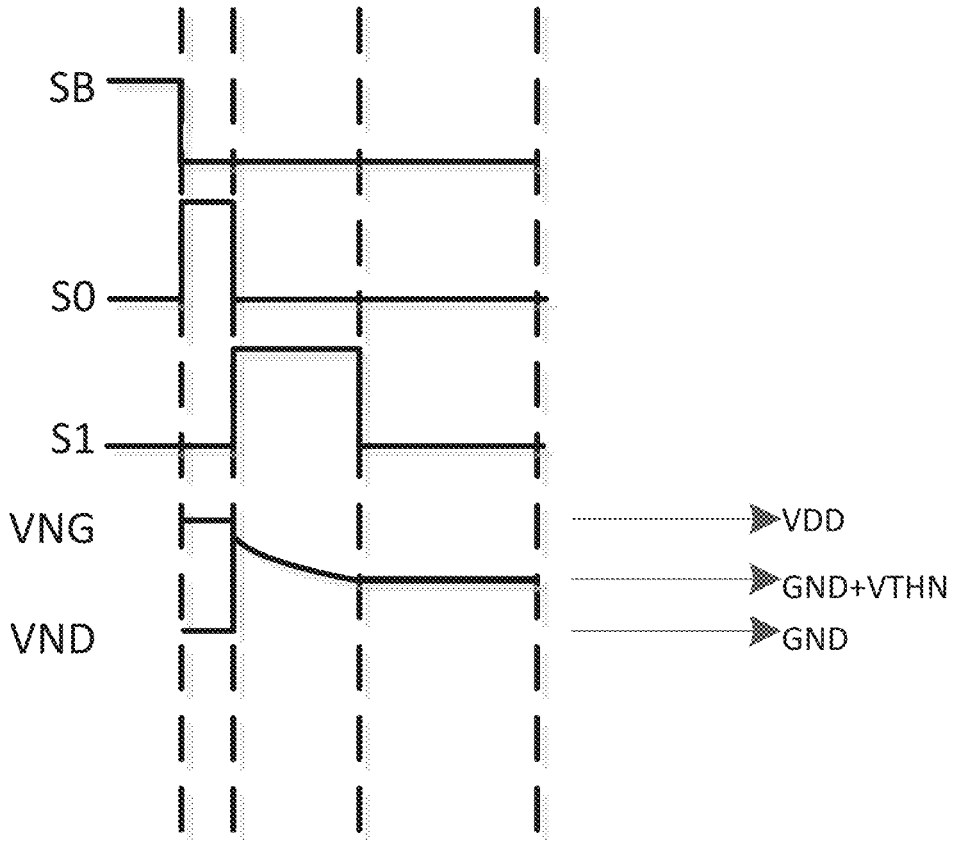
FIG. 4 is a drive timing graph according to an embodiment of the present disclosure.

FIG. 4 is a drive timing graph according to an embodiment of the present disclosure, and this drive timing may be applied to the data current generation circuit shown in FIG. 3. The working principle of the data current generation circuit according to the embodiment of the present disclosure will be described below by using an example in which the first transistor T1, the second transistor T2, the third transistor T3, the fourth transistor T4, and the fifth transistor T5 are N-type transistors in conjunction with FIGS. 3 and 4. The signals of the first control signal input terminal S2 and the second control signal input terminal XS2 are reversal signals. In other words, the signal of the first control signal input terminal S2 is a logic high level while the signal of the second control signal input terminal XS2 is a logic low level; the signal of the first control signal input terminal S2 is a logic low level while the signal of the second control signal input terminal XS2 is a logic high level. It is to be noted that the logic high level is relatively higher than the logic low level. For example, for the second transistor T2, as long as the signal of the gate can control the second transistor T2 to be turned on, the signal is a logic high level, and as long as the signal of the gate can control the second transistor T2 to be turned off, the signal is a logic low level. The operating process of the data current generation circuit includes a threshold capture stage. At the threshold capture stage, the signal of the first control signal input terminal S2 is a logic low level, and the second transistor T2 is turned off; the signal of the second control signal input terminal XS2 is a logic high level, and the third transistor T3 and the fourth transistor T4 are turned on. For convenience, VDD denotes the voltage of the first voltage input terminal VDD, which is a high-level voltage, and GND denotes the voltage of the ground terminal, which is zero. The threshold capture stage includes a first stage and a second stage.

At the first stage, the signal of the third control signal input terminal S0 is a logic high level, the signal of the fourth control signal input terminal S1 is a logic low level, the fifth transistor T5 is turned on, and the sixth transistor T6 is turned off. The gate voltage of the first transistor T1 is VDD, the voltage of the second electrode VIP of the first capacitor C1 is VDD, and the voltage of the second electrode VND of the first transistor is equal to GND.

At the second stage, the signal of the third control signal input terminal S0 is a logic low level, the fifth transistor T5 is turned off, the signal of the fourth control signal input terminal S1 is a logic high level, and the sixth transistor T6 is turned on. Since there is no current path, the voltages of the gate VNG of the first transistor T1 and the second electrode VIP of the first capacitor C1 gradually decrease, and finally, the difference between the gate voltage and the source (first electrode) voltage of the first transistor T1 is equal to the threshold voltage VTHN of the first transistor T1. Since the source is grounded, the source voltage is zero, and then the gate voltage of the first transistor T1 is equal to the threshold voltage VTHN of the first transistor T1. That is, the voltage difference across the first capacitor C1 is VTHN. Therefore, the threshold voltage VTHN of the first transistor T1 is stored across the first capacitor C1.

When the current generation circuit needs to output a corresponding data current, the voltage of the first control signal input terminal S2 is controlled to be a logic high level, the second transistor T2 is turned on, and the data voltage VDATA generated by the data voltage generation circuit 11 is transmitted to the first terminal VCB of the first capacitor C1. The voltages across the first electrode VCB and the second electrode VIP of the first capacitor C1 are VCB=GND and VIP=VTHN, respectively, in the previous state. When the second transistor T2 is turned on, the voltage of the first electrode VCB of the first capacitor C1 becomes the data voltage VDATA, and the voltage of the second electrode VIP of the first capacitor C1 becomes VTHN+VDATA. Through the operational amplifier SOP, the voltage VNG of the gate of the first transistor T1 is equal to the voltage of the second electrode VIP of the first capacitor C1, that is, VTHN+VDATA. The current ID_N1 passing through the first transistor T1 is $$\begin{aligned} \text{ID_N1} &= \frac{1}{2} * \mu_n * Cox * \frac{W}{L} * (VGS - VTHN)^2 = \\ &\frac{1}{2} * \mu_n * Cox * \frac{W}{L} * (VTHN + VDATA - VTHN)^2 = \\ &\frac{1}{2} * \mu_n * Cox * \frac{W}{L} * (VDATA)^2. \end{aligned}$$

In the above formula, $\mu_n$, Cox, and $$\frac{W}{L}$$

denote the mobility, oxide layer thickness, and width-to-length ratio of the transistor, respectively.

It can be seen that in the case where the data voltage (grayscale voltage) VDATA is the same, the current generated by the data current generation circuit is only correlated with the mobility, oxide layer thickness, and the width-to-length ratio of the first transistor T1, and none of these factors of the first transistor T1 varies dramatically with the process. Therefore, the effect of the process on the current generated by the different first transistors T1 can be reduced, thereby improving the display uniformity. The threshold voltage VTHN of the first transistor T1 is stored across the first capacitor C1 and does not change with the change of the data voltage VDATA. Therefore, after the data voltage VDATA changes, the capture of the threshold voltage is not required. According to the solution provided in the embodiment of the present disclosure, the time for threshold capture and compensation can be saved, thereby reducing the time required for scanning in one row.

Figure 5:
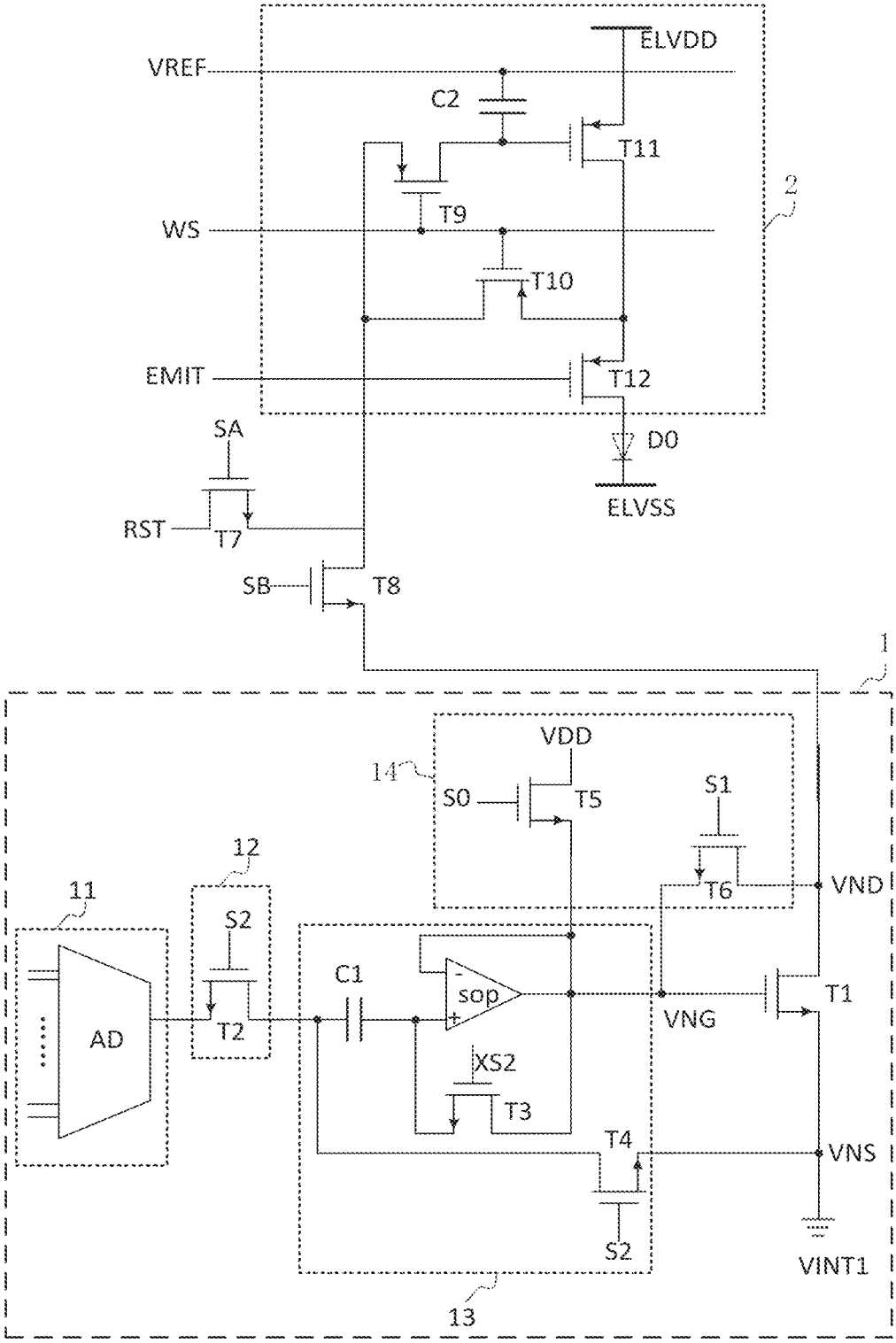
FIG. 5 is a schematic diagram showing a current generation circuit for driving a pixel circuit to work according to an embodiment of the present disclosure.

FIG. 5 is a schematic diagram showing a current generation circuit driving a pixel circuit to work according to an embodiment of the present disclosure. The data current generation circuit 1 provided in the embodiment of the present disclosure can drive any pixel circuit 2 to operate as long as the data current generated by the data current generation circuit 1 is inputted to the pixel circuit at the programming stage of the pixel circuit 2, and the pixel circuit 2 is driven to emit light and display in accordance with the working timing of the pixel circuit.

An embodiment of the present disclosure further provides a data current driver chip including the data current generation circuit provided in any one of the embodiments of the present disclosure. Therefore, the data current driver chip has all the technical features of the data current generation circuit provided in any one of the embodiments of the present disclosure and thus has the beneficial effects of the data current generation circuit provided in any one of the embodiments of the present disclosure, and details are not described here.

Figure 6:
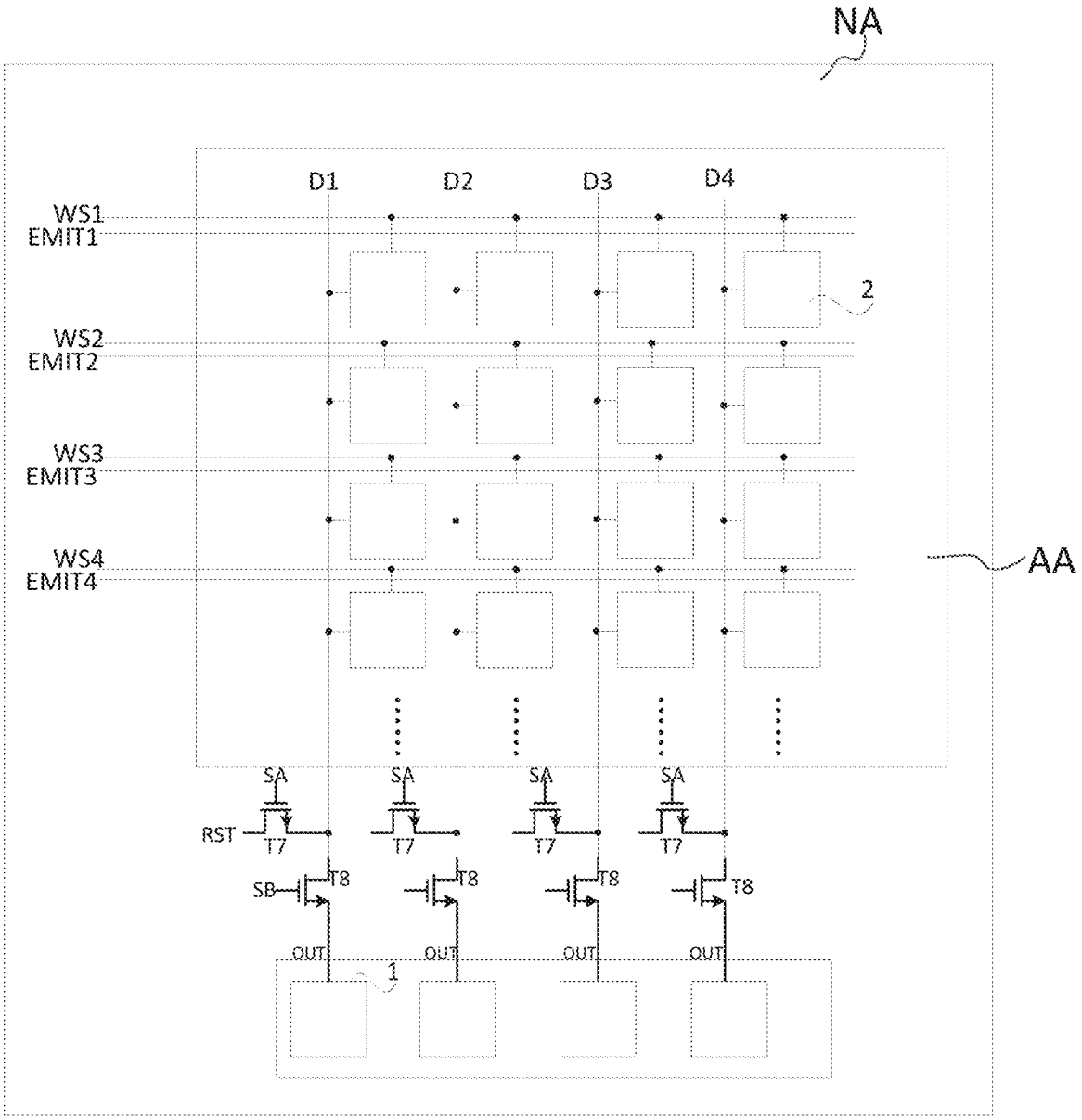
FIG. 6 is a structural diagram of a display panel according to an embodiment of the present disclosure.

An embodiment of the present disclosure further provides a display panel. FIG. 6 is a structural diagram of a display panel according to an embodiment of the present disclosure. The display panel includes a display region AA and a non-display region NA. The display region AA is provided with a plurality of pixel circuits 2, and the non-display area NA is provided with the data current generation circuit 1 provided in any one of the embodiments of the present disclosure.

Each pixel circuit 2 is electrically connected to the data current generation circuit 1 through a data line and a switch module 221. The data current generation circuit 1 supplies a data current to each pixel circuit 2 through the data line and the switch module 221.

Specifically, the display panel further includes a gate driving circuit located in the non-display region NA. The gate driving circuit supplies scan signals to the pixel circuits 2 through the scan lines (WS1, WS2, WS3, WS4, and the like). The data current generation circuit may be integrated into the chip and supply the data current to the pixel circuits 2 through the data lines (D1, D2, D3, D4, and the like) connected to the chip. The pixel circuits 2 are connected to the data lines (D1, D2, D3, D4, and the like) corresponding to these pixel circuits 2 under the action of scan signals. When the switch module is turned on, the switch module in FIG. 6 includes an eighth transistor T8. The data lines (D1, D2, D3, D4, and the like) obtain data currents from the current generation circuit 1 and transmit the data currents to the pixel circuits 2, and thus the pixel circuits emit light, thereby achieving the display of the display panel.

As shown in FIG. 6, the electrical display panel provided by the embodiment of the present disclosure includes the data current generation circuit 1 of any one of the embodiments of the present disclosure. The display panel may be the display panel of a mobile phone as shown in FIG. 6 or may be a display panel of an electronic device such as a computer, a television, and an intelligent wearable device, which is not particularly limited in this embodiment.

Optionally, the display panel may further include a seventh transistor T7. The switch module 221 includes an eighth transistor T8. The gate of the seventh transistor T7 is electrically connected to a reset control signal input terminal SA, the first electrode of the seventh transistor T7 is electrically connected to a data current input terminal IN1 of the pixel circuit 2 through a data line, and the second electrode of the seventh transistor T7 is electrically connected to the reset signal input terminal RST. The gate of the eighth transistor T8 is electrically connected to a fifth control signal input SB, the first electrode of the eighth transistor T8 is electrically connected to the second electrode of the first transistor T1 of the data current generation circuit 1, and the second electrode of the eighth transistor T8 is electrically connected to the data current input terminal IN1 of the pixel circuit 2 through a data line.

Optionally, with reference to FIG. 5, the pixel circuit 2 may include a ninth transistor T9, a tenth transistor T10, an eleventh transistor T11, a twelfth transistor T12, a second capacitor C2, and a light-emitting device D0. The first electrode of the ninth transistor T9 and the second electrode of the tenth transistor T10 are electrically connected to the data current input terminal IN1 of the pixel circuit 2. The second electrode of the ninth transistor T9 is electrically connected to the gate of the eleventh transistor T11 and the first electrode of the second capacitor C2. The gate of the ninth transistor T9 and the gate of the tenth transistor T10 are electrically connected to a scan signal input terminal WS of the pixel circuit 2. The first electrode of the tenth transistor T10 is electrically connected to the second electrode of the eleventh transistor T11. The first electrode of the eleventh transistor T11 is electrically connected to the first power signal input terminal ELVDD of the pixel circuit 2. The second electrode of the second capacitor C2 is electrically connected to the second reference voltage input terminal VREF of the pixel circuit 2. The second electrode of the eleventh transistor T11 is electrically connected to the first electrode of the twelfth transistor T12. The gate electrode of the twelfth transistor T12 is electrically connected to the light emission control signal input terminal EMIT of the pixel circuit 2. The second electrode of the twelfth transistor T12 is electrically connected to the anode of the light-emitting device D0. The cathode of the light-emitting device D0 is electrically connected to the second power signal input terminal ELVSS of the pixel circuit 2.

Figure 7:
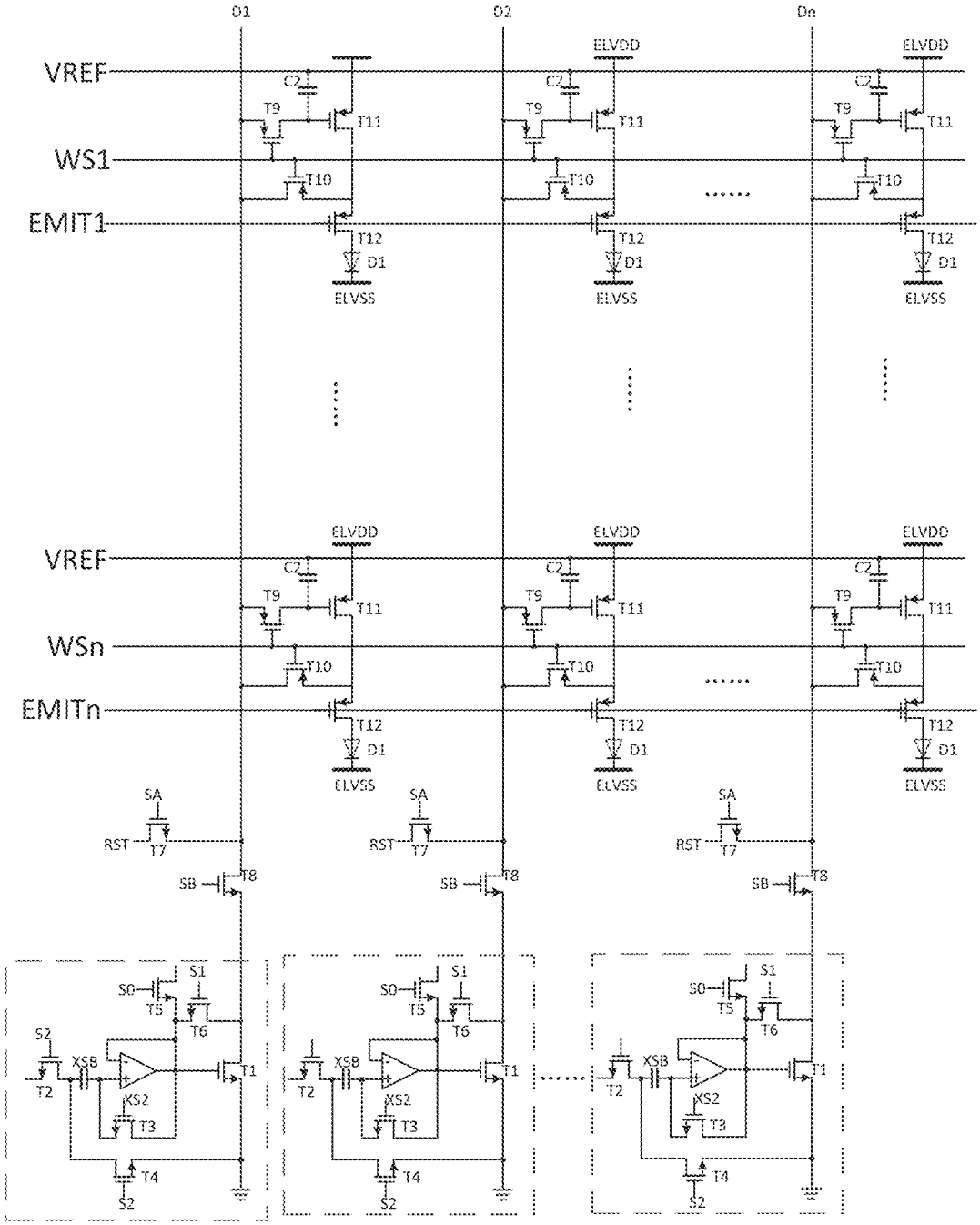
FIG. 7 is a structural diagram of another display panel according to an embodiment of the present disclosure.
Figure 8:
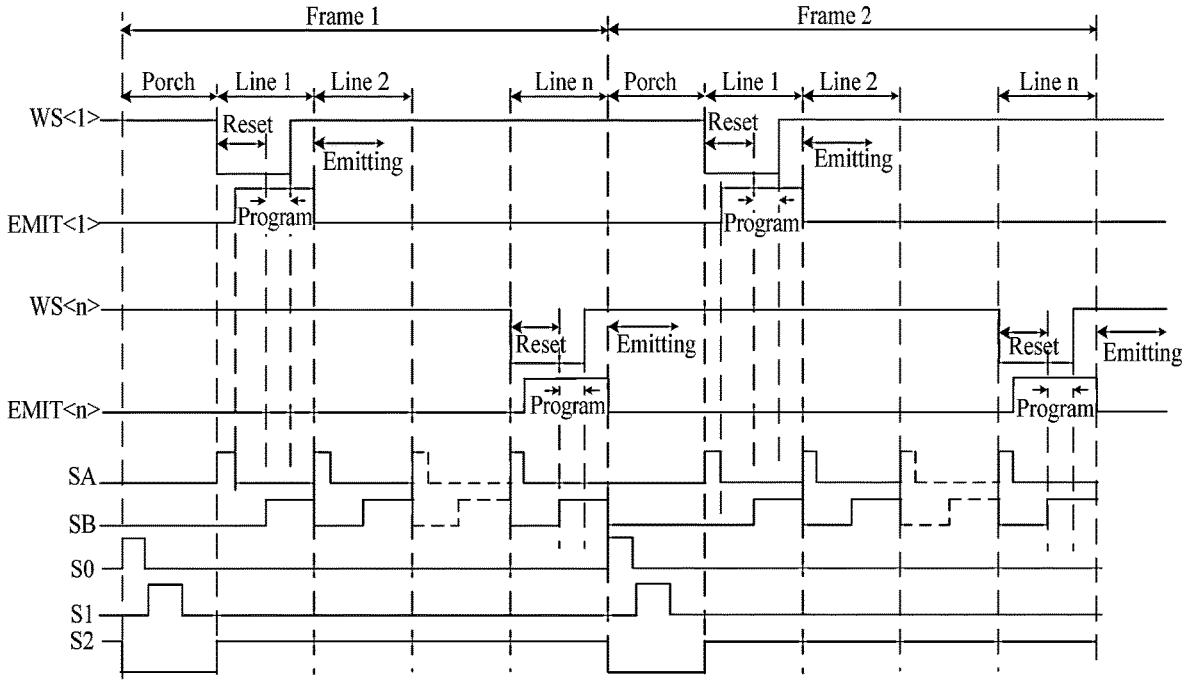
FIG. 8 is another drive timing graph according to an embodiment of the present disclosure.

FIG. 7 is a structural diagram of another display panel according to an embodiment of the present disclosure. For example, the display panel includes n rows of pixel circuits. FIG. 8 is another drive timing graph according to an embodiment of the present disclosure. The working principle of the current generation circuit 1 and the pixel circuit 2 is described below with reference to FIGS. 7 and 8. The timing in FIG. 8 is illustrated by using an example of two frames. In FIG. 8, Frame1 denotes the first frame, Frame2 denotes the second frame, WS<n> denotes a scan line in an $n^{th}$ row and also denotes a signal at a scan signal input terminal of the pixel circuit in the $n^{th}$ row, and EMIT<n> denotes a light emission control signal line in an $n^{th}$ row and also denotes a signal at a light emission control signal terminal of the pixel circuit in the $n^{th}$ row.

The scan stage in each row includes a reset stage, a programming stage, and a light emission stage. In FIG. 8, Reset denotes the reset stage, Program denotes the programming stage and Emitting denotes the light emission stage.

For scan stage in the first row, the data voltage generation module outputs the data voltage VDATA1 of the first row, and the voltage of the first electrode VCB of the first capacitor C1 is equal to VDATA1 of the first row. Then, the voltage of the second electrode VIP of the first capacitor C1 is VDATA1+VTHN, and through the operational amplifier SOP and the first transistor T1, the generated data current $$ID_N1 = \frac{1}{2} * \mu_n * Cox * \frac{W}{L} * (VDATA1)^2.$$

At the reset stage, the votage of the reset control signal input terminal SA is a logic high level, the signal of the fifth control signal input terminal SB is a logic low level, the seventh transistor T7 is turned on, and the eighth transistor T8 is turned off. The signal of scan signal input terminal WS<1> is a logic low level, the ninth transistor T9, the tenth transistor T10, and the twelfth transistor T12 are turned on, and the reset voltage RST is written to the gate of the eleventh transistor T11 and the first electrode of the second capacitor C2 through the seventh transistor T7 and ninth transistor T9 that are turned on. The gate of the eleventh transistor T11 and the second capacitor C2 are reset, and the reset voltage RST is written to the anode of the light-emitting device D0 through the tenth transistor T10 and the twelfth transistor T12 that are turned on. At the reset stage, the potential of the reset control signal input terminal SA is converted from a logic high level to a logic low level. At the same time, when the potential of the reset control signal input terminal SA is converted from a logic high level to a logic low level, the signal of EMIT is converted from a logic low level to a logic high level, the seventh transistor T7 and the twelfth transistor T12 are turned from ON to OFF, and the light-emitting device D0 stops receiving the reset signal.

At the programming stage, the signal of the reset control signal input terminal SA is a logic low level, the signal of the fifth control signal input terminal SB is a logic high level, the seventh transistor T7 is turned off, and the eighth transistor T8 is turned on. The current generated by the data current generation circuit passes through the data lines (D1, D2, . . . , and Dn) and are inputted to the first row of pixel circuits, and specifically, the voltage of the second capacitor C2 is programmed through the eighth transistor T8 and the ninth transistor T9 that are turned on.

At the light emission stage, the signal of the light emission control signal input terminal EMIT is a logic low level, the twelfth transistor T12 is turned on, and the eleventh transistor T11 generates a drive current according to the voltage stored in the second capacitor C2 to drive the light-emitting device D0 to emit light. The light emission action in the first row is completed.

For scan stage in the second row;

the data voltage generation module outputs the data voltage VDATA2 of the second row, and the voltage of the first electrode VCB of the first capacitor C2 is equal to VDATA2 of the second row. Then, the voltage of the second electrode VIP of the first capacitor C1 is VDATA2+VTHN, and through the operational amplifier SOP and the first transistor T1, the generated data current $$ID_N1 = \frac{1}{2} * \mu_n * Cox * \frac{W}{L} * (VDATA2)^2.$$

At the reset stage, the signal of the reset control signal input terminal SA is a logic high level, the signal of the fifth control signal input terminal SB is a logic low level, the seventh transistor T7 in the pixel circuit in the second row is turned on, and the eighth transistor T8 is turned off. The signal of scan signal input terminal WS2 is a logic low level, the ninth transistor T9, the tenth transistor T10, and the twelfth transistor T12 are turned on, and the reset voltage RST is written to the gate of the eleventh transistor T11 and the first electrode of the second capacitor C2 through the seventh transistor T7 and ninth transistor T9 that are turned on. The gate of the eleventh transistor T11 and the second capacitor C2 are reset, and the reset voltage RST is written to the anode of the light-emitting device D0 through the tenth transistor T10 and the twelfth transistor T12 that are turned on. At the reset stage, the potential of the reset control signal input terminal SA is converted from a logic high level to a logic low level. At the same time, when the potential of the reset control signal input terminal SA is converted from a logic high level to a logic low level, the signal of the EMIT is converted from a logic low level to a logic high level, the seventh transistor T7 and the twelfth transistor T12 are turned from ON to OFF, and the light-emitting device D0 stops receiving the reset signal.

At the programming stage, the signal of the reset control signal input terminal SA is a logic low level, the signal of the fifth control signal input terminal SB is a logic high level, the seventh transistor T7 is turned off, and the eighth transistor T8 is turned on. The current generated by the data current generation circuit passes through the data lines (D1, D2, . . . , and Dn) and are inputted to the pixel circuits, and specifically, the voltage of the second capacitor C2 is programmed through the eighth transistor T8 and the ninth transistor T9 that are turned on.

At the light emission stage, the signal of the light emission control signal input terminal EMIT is a logic low level, the twelfth transistor T12 is turned on, and the eleventh transistor T11 generates a drive current according to the voltage stored in the second capacitor C2 to drive the light-emitting device D0 to emit light. The light emission action in the second row is completed.

The scan is performed progressively until the scanning in the full-frame display region is completed.

In the solution provided by the embodiment of the present disclosure, the duration for performing image display may include a display duration and a non-display duration when performing image display. The data current generation circuit performs the threshold capture at the non-display duration. Since the threshold voltage of the first transistor T1 is stored across the first capacitor C1 after the execution of the threshold capture is completed, the first transistor may be compensated for at the display duration by using the threshold voltage stored in the first capacitor C1 so that the first transistor generates a data current independent of the threshold voltage. That is, the threshold capture stage does not occupy the display duration so that the refresh rate is easily improved, thereby improving the display effect.

The non-display duration may be a gap time between every two adjacent frame scanning periods, or the non-display duration is a screen turn-off time or a shutdown time of the display panel. As shown in FIG. 8, the threshold capture stage Porch precedes the scan stage of the first row in each frame, that is, the threshold capture stage Porch is in the gap time between two adjacent frame scanning periods.

In another implementation of the embodiment of the present disclosure, the duration for performing image display may include a display duration and a non-display duration. Within the display duration, the data current generation circuit performs the threshold capture once after every multi-row scanning. In the drive timing graph shown in FIG. 8, the threshold capture is performed once before the scan stage of the first row in each frame, or the threshold capture may be performed once each of several rows to prevent the leakage of the first capacitor from changing the stored threshold voltage, thereby reducing the influence of the leakage on the stored threshold voltage and ensuring the display effect. The scan stage of each row between two adjacent threshold captures can be adjusted adaptively according to the specific display panel, which is not specifically limited in this embodiment of the present disclosure. Compared with the related art in which the threshold capture is required at the scan stage in each row, the solution provided in the embodiment of the present disclosure can save the threshold capture time, reduce the time required for scanning in one row, and facilitate high refresh rate display.

Figure 9:
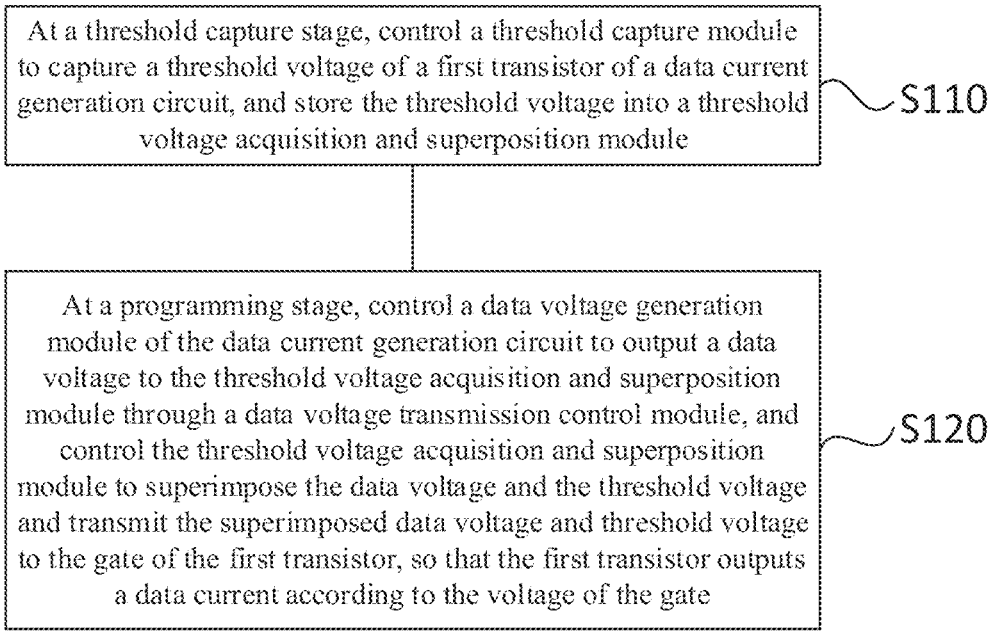
FIG. 9 is a flowchart of a driving method of a data current generation circuit according to an embodiment of the present disclosure.

Based on the same concept, an embodiment of the present disclosure further provides a driving method of a data current generation circuit. FIG. 9 is a flowchart of a driving method of a data current generation circuit according to an embodiment of the present disclosure. As shown in FIG. 9, the method of this embodiment includes the steps described below.

In step S110, at a threshold capture stage, the threshold capture module is controlled to capture a threshold voltage of a first transistor of the data current generation circuit, and the threshold voltage is stored into the threshold voltage acquisition and superposition module.

In step S120, at a programming stage, a data voltage generation module of the data current generation circuit is controlled to output a data voltage to the threshold voltage acquisition and superposition module through a data voltage transmission control module, and the threshold voltage acquisition and superposition module is controlled to superimpose the data voltage and the threshold voltage and transmit the superimposed data voltage and threshold voltage to the gate of the first transistor so that the first transistor outputs a data current according to the voltage of the gate.

In the embodiment of the present disclosure, the data current generation circuit includes a threshold capture module, a data voltage generation module, a data current transmission module, a threshold voltage acquisition and superposition module, and a first transistor. In the operating process of the data current generation circuit, the threshold capture module is connected between the gate and the second electrode of the first transistor to capture a threshold voltage of the first transistor, the data voltage generation module may generate a data voltage, the data voltage transmission module transmits the data voltage to the threshold voltage acquisition and superposition module, the threshold voltage acquisition and superposition module can superpose the threshold voltage of the first transistor and the data voltage and then transmit the superposed data voltage and threshold voltage to the gate of the first transistor, and the second electrode of the first transistor serves as an output terminal of the data current generation circuit and outputs a data current according to the voltage of the gate. In the embodiments, the gate voltage of the first transistor for outputting a data current is correlated with the threshold voltage of the first transistor. When the first transistor outputs the data current, the gate voltage can compensate for the influence of the threshold voltage of the first transistor on the data current to improve the degree of matching between the data voltage and the data current, thereby improving the uniformity of the display panel.

Optionally, the duration for performing image display may include a display duration and a non-display duration. The data current generation circuit performs the threshold capture stage at the non-display duration.

Optionally, the non-display duration may be a gap time between every two adjacent frame scanning periods, or the non-display duration is a screen turn-off duration or a shutdown time of the display panel. That is, the threshold capture stage does not occupy the display duration, that is, the threshold capture stage does not occupy the scan time, thereby facilitating the implementation of the refresh rate and improving the display effect.

Optionally, the duration for performing image display may include a display duration and a non-display duration when performing image display. Within the display duration, the data current generation circuit performs the threshold capture stage once after every multi-row scanning.

In the embodiment of the present disclosure, the threshold capture may be performed once before the scan stage of the first row in each frame, or the threshold capture may be performed once each of several rows to prevent the leakage of the first capacitor from changing the stored threshold voltage, thereby reducing the influence of the leakage on the stored threshold voltage and ensuring the display effect. The scan stage of each row between two adjacent threshold captures can be adjusted adaptively according to the specific display panel, which is not specifically limited in this embodiment of the present disclosure. Compared with the related art in which the threshold capture is required at the scan stage in each row, the solution provided in the embodiment of the present disclosure can save the threshold capture time, reduce the time required for scanning in one row, and facilitate high refresh rate display.

It is to be noted that the preceding are only preferred embodiments of the present disclosure and the technical principles used therein. It is to be understood by those skilled in the art that the present disclosure is not limited to the embodiments described herein. Those skilled in the art can make various apparent modifications and substitutions without departing from the scope of the present disclosure. Therefore, while the present disclosure has been described in detail via the preceding embodiments, the present disclosure is not limited to the preceding embodiments and may include equivalent embodiments without departing from the concept of the present disclosure. The scope of the present disclosure is determined by the scope of the appended claims.

What is claimed is:

1. A data current generation circuit, comprising: a threshold capture module, a data voltage generation module, a data voltage transmission module, a threshold voltage acquisition and superposition module, and a first transistor;

wherein the threshold capture module is connected between a gate and a second electrode of the first transistor and is configured to capture a threshold voltage of the first transistor;

the data voltage generation module is configured to generate a data voltage;

the data voltage transmission module is connected between the data voltage generation module and the threshold voltage acquisition and superposition module and is configured to transmit the data voltage generated by the data voltage generation module to the threshold voltage acquisition and superposition module when the data voltage transmission module is turned on;

the threshold voltage acquisition and superposition module is connected to the gate and a first electrode of the first transistor and is configured to acquire the threshold voltage of the first transistor, superpose the data voltage transmitted by the data voltage transmission module and the threshold voltage, and transmit the superposed data voltage and threshold voltage to the gate of the first transistor; and the second electrode of the first transistor serves as an output terminal of the data current generation circuit and is configured to output a data current according to a voltage of the gate of the first transistor.

2. The data current generation circuit of claim 1, comprising a second transistor;

wherein a gate of the second transistor is electrically connected to a first control signal input terminal, a first electrode of the second transistor is electrically connected to the data voltage generation circuit, and a second electrode of the second transistor is electrically connected to the threshold voltage acquisition and superposition module.

3. The data current generation circuit of claim 1, wherein the threshold voltage acquisition and superposition module comprises a third transistor, a fourth transistor, a first capacitor, and an operational amplifier;

wherein a first electrode of the first capacitor is connected to the data voltage transmission module, a second electrode of the first capacitor is connected to a first input terminal of the operational amplifier, and a second input terminal of the operational amplifier is connected to an output terminal of the operational amplifier;

a first electrode of the third transistor is connected to a first input terminal of the operational amplifier, a second electrode of the third transistor is connected to the output terminal of the operational amplifier, and a gate of the third transistor is electrically connected to a second control signal input terminal; and a first electrode of the fourth transistor is connected to the first electrode of the first capacitor, a second electrode of the fourth transistor is connected to the first electrode of the first transistor and is connected to a reference voltage, and a gate of the fourth transistor is electrically connected to the second control signal input terminal.

4. The data current generation circuit of claim 3, wherein the first electrode of the first transistor is grounded.

5. The data current generation circuit of claim 1, wherein the threshold capture module comprises a fifth transistor and a sixth transistor;

a second electrode of the fifth transistor is connected to a first level signal input terminal, a first electrode of the fifth transistor is connected to the gate of the first transistor, and a gate of the fifth transistor is connected to a third control signal input terminal; and a first electrode of the sixth transistor is connected to the gate of the first transistor, a second electrode of the sixth transistor is connected to the second electrode of the first transistor, and a gate of the sixth transistor is connected to a fourth control signal input terminal.

6. A display panel, comprising a display region and a non-display region; wherein the display region is provided with a plurality of pixel circuits, and the non-display region is provided with the data current generation circuit of claim 1;

each of the plurality of pixel circuits is electrically connected to the data current generation circuit through a data line and a switch module; and a data current generated by the data current generation circuit is supplied to the each of the plurality of pixel circuits through the data line and the switch module.

7. The display panel of claim 6, further comprising a seventh transistor; wherein the switch module comprises an eighth transistor;

wherein a gate of the seventh transistor is electrically connected to a reset control signal input terminal, a first electrode of the seventh transistor is electrically connected to a data current input terminal of the each of the plurality of pixel circuits through the data line, and a second electrode of the seventh transistor is electrically connected to the reset signal input terminal; and a gate of the eighth transistor is electrically connected to a fifth control signal input terminal, a first electrode of the eighth transistor is electrically connected to the second electrode of the first transistor of the data current generation circuit, and a second electrode of the eighth transistor is electrically connected to the data current input terminal of the each of the plurality of pixel circuits through the data line.

8. The display panel of claim 6, wherein the each of the plurality of pixel circuits comprises a ninth transistor, a tenth transistor, an eleventh transistor, a twelfth transistor, a second capacitor, and a light-emitting device;

a first electrode of the ninth transistor and a second electrode of the tenth transistor are electrically connected to the data current input terminal of the each of the plurality of pixel circuits, a second electrode of the ninth transistor is electrically connected to a gate of the eleventh transistor and a first electrode of the second capacitor, a gate of the ninth transistor and a gate of the tenth transistor are electrically connected to a scan signal input terminal of the each of the plurality of pixel circuits;

a first electrode of the tenth transistor is electrically connected to a second electrode of the eleventh transistor, a first electrode of the eleventh transistor is electrically connected to a first power signal input terminal of the each of the plurality of pixel circuits, a second electrode of the second capacitor is electrically connected to a second reference voltage input terminal of the each of the plurality of pixel circuits, the second electrode of the eleventh transistor is electrically connected to a first electrode of the twelfth transistor; and a gate electrode of the twelfth transistor is electrically connected to a light emission control signal input terminal of the each of the plurality of pixel circuits, a second electrode of the twelfth transistor is electrically connected to an anode of the light-emitting device, and a cathode of the light-emitting device is electrically connected to a second power signal input terminal of the each of the plurality of pixel circuits.

9. A driving method for a data current generation circuit, configured to drive the data current generation circuit of claim 1, comprising:

at a threshold capture stage, controlling the threshold capture module to capture a threshold voltage of a first transistor of the data current generation circuit, and storing the threshold voltage into the threshold voltage acquisition and superposition module; and at a programming stage, controlling the data voltage generation module of the data current generation circuit to output a data voltage to the threshold voltage acquisition and superposition module through the data voltage transmission control module, and controlling the threshold voltage acquisition and superposition module to superimpose the data voltage and the threshold voltage and transmit the superimposed data voltage and threshold voltage to a gate of the first transistor, so that the first transistor outputs a data current according to a voltage of the gate.

10. The driving method of a data current generation circuit of claim 9, wherein a duration for performing image display a display duration and a non-display duration; and the data current generation circuit performs the threshold capture stage in the non-display duration.

11. The driving method of a data current generation circuit of claim 10, wherein the non-display duration is a gap time between every two adjacent frame scanning periods; or the non-display duration is a screen turn-off time or a shutdown time of the display panel.

12. The driving method of a data current generation circuit of claim 9, wherein a duration performing image display comprises a display duration and a non-display duration; and within the display duration, the data current generation circuit performs the threshold capture stage once after every multi-row scanning.

13. A data current driver chip, comprising a data current generation circuit, wherein the data current generation circuit comprises: a threshold capture module, a data voltage generation module, a data voltage transmission module, a threshold voltage acquisition and superposition module, and a first transistor;

wherein the threshold capture module is connected between a gate and a second electrode of the first transistor and is configured to capture a threshold voltage of the first transistor;

the data voltage generation module is configured to generate a data voltage;

the data voltage transmission module is connected between the data voltage generation module and the threshold voltage acquisition and superposition module and is configured to transmit the data voltage generated by the data voltage generation module to the threshold voltage acquisition and superposition module when the data voltage transmission module is turned on;

the threshold voltage acquisition and superposition module is connected to the gate and a first electrode of the first transistor and is configured to acquire the threshold voltage of the first transistor, superpose the data voltage transmitted by the data voltage transmission module and the threshold voltage, and transmit the superposed data voltage and threshold voltage to the gate of the first transistor; and the second electrode of the first transistor serves as an output terminal of the data current generation circuit and is configured to output a data current according to a voltage of the gate of the first transistor.

* * * * *